US009943947B2

(12) United States Patent
Tseng

(10) Patent No.: US 9,943,947 B2
(45) Date of Patent: Apr. 17, 2018

(54) MULTIPURPOSE MODULAR BIT ASSEMBLY

(71) Applicant: Allium LLC, South Euclid, OH (US)

(72) Inventor: Kuan-Chun Tseng, Taiwan (CN)

(73) Assignee: Allium LLC, South Euclid, OH (US)

( * ) Notice: Subject to any disclaimer, the term of this patent is extended or adjusted under 35 U.S.C. 154(b) by 0 days.

(21) Appl. No.: 14/850,502

(22) Filed: Sep. 10, 2015

(65) Prior Publication Data

US 2017/0074308 A1 Mar. 16, 2017

(51) Int. Cl.

| | |
|---|---|
| ***B25B 23/00*** | (2006.01) |
| ***B25F 1/02*** | (2006.01) |
| ***B43K 23/06*** | (2006.01) |
| ***B43K 29/00*** | (2006.01) |
| ***B25B 13/06*** | (2006.01) |

(Continued)

(52) U.S. Cl.

CPC ..... *B25B 23/0035* (2013.01); *B25B 13/06* (2013.01); *B25B 15/001* (2013.01); *B25B 23/0007* (2013.01); *B25B 23/0021* (2013.01); *B25B 23/12* (2013.01); *B43K 23/06* (2013.01); *B43K 29/004* (2013.01); *Y10T 403/125* (2015.01); *Y10T 403/362* (2015.01)

(58) Field of Classification Search

CPC A63H 33/00; B25B 23/0007; B25B 23/0035; B25F 1/02; B25F 1/04; B25G 1/04; B25G 1/043; B25G 1/08; B25G 1/085; B43K 29/00; B43K 29/004; F16B 13/00; F21L 4/00; F21V 21/0965; Y10T 403/12; Y10T 403/125; Y10T 403/1616; Y10T 403/36; Y10T 403/362; Y10T 403/4648; Y10T 403/55; Y10T 403/553; Y10T 403/57; Y10T 403/7096

USPC ..... 403/3, 4, 13, 180, 181, 247, 292, 294, 403/300, 382; 81/437–440

See application file for complete search history.

(56) References Cited

U.S. PATENT DOCUMENTS

| | | | | |
|---|---|---|---|---|
| 4,399,723 A * | 8/1983 | Marleau | ..... | B25G 1/085 81/437 |
| 5,044,804 A * | 9/1991 | Chuang | ..... | B43K 5/005 401/34 |

(Continued)

FOREIGN PATENT DOCUMENTS

| | | |
|---|---|---|
| GB | 2225971 | 6/1990 |

OTHER PUBLICATIONS

"Magnetizing Objects with a Bar Magnet." Apex Magnets. Jan. 30, 2015, [online], [retrieved on Apr. 26, 2017]. Retrieved from the Internet <URL: https://www.apexmagnets.com/news-how-tos/magnetizing-objects-with-a-bar-magnet/>.*

(Continued)

*Primary Examiner* — Josh Skroupa

(74) *Attorney, Agent, or Firm* — McDonald Hopkins LLC

(57) ABSTRACT

A multi-purpose tool assembly may comprise one or more body members. A body member may comprise a magnet, a main body and a bit. The main body may comprise various sides, one or more of which may include one or more apertures on its surface and one or more bits protruding therefrom. The bit may include a bit body and a bit head. The body members may include differently configured bits. Bits may be inserted into the apertures to connect the body members. The bit assembly may comprise one or more attachment members. An attachment member may attach two or more bits together.

19 Claims, 8 Drawing Sheets

(51) Int. Cl.
*B25B 15/00* (2006.01)
*B25B 23/12* (2006.01)

(56) References Cited

U.S. PATENT DOCUMENTS 5,842,394 A 12/1998 Hwang
5,899,127 A * 5/1999 Shiao ..... B25B 15/02 81/177.4
5,904,080 A 5/1999 Anderson et al.
6,149,330 A * 11/2000 Chuang ..... B43K 7/005 401/34
6,425,307 B1 * 7/2002 Chen ..... B25G 1/085 81/438
D475,085 S * 5/2003 Whitehorn ..... D19/118
6,688,792 B1 * 2/2004 Reichmann ..... B43K 27/08 401/18
D502,215 S * 2/2005 Hung ..... D19/118
7,774,963 B2 * 8/2010 Puglisi ..... G09F 23/00 40/334
8,220,368 B2 * 7/2012 Chen ..... B25B 13/56 81/436
8,257,131 B2 * 9/2012 Truckai ..... A63H 33/088 401/195
2005/0098001 A1 * 5/2005 Walker ..... B25B 13/06 81/439
2010/0294089 A1 * 11/2010 Lai ..... B25G 1/043 81/177.6
2011/0088522 A1 4/2011 Floyd
2015/0052686 A1 * 2/2015 Davis ..... B25B 13/56 7/165
2016/0039084 A1 * 2/2016 Tsai ..... B25G 1/085 81/438

OTHER PUBLICATIONS

International Search Report, PCT/US 15/49447, dated Dec. 10, 2015.
"Polar Pen Magnetic Pen / Modular pen made from Magnets." Polar. [online], [retrieved on Mar. 9, 2016]. Retrieved from the Internet <URL: https://www.amazon.com/poler-magnetic-modular-magnets-gold/dp/b00h0eja7i/ref=cm_cr_arp_d_product_top?e=utf8>.

* cited by examiner

MULTIPURPOSE MODULAR BIT ASSEMBLY

TECHNICAL FIELD

The present invention relates to a bit assembly, more particularly, to a multipurpose modular bit assembly comprising a plurality of attachable body members.

BACKGROUND

Manual and powered tools have become more sophisticated and specialized to address the widely varying needs that are faced in modern life. However, while such tools have been highly beneficial, there have remained a number of vexing problems of rather significant proportions. Many traditional tools are designed for a particular or specialized purpose.

Such specialized tools allow for competition of a wide range of different tasks but, on the other hand, the sheer number of tools which are required for these tasks is oftentimes staggering and expensive. In addition, switching between tools may be burdensome, time consuming, and frustrating as users attempt to locate each tool and switch back and forth between tools. The need to switch between tools may be particularly frustrating when a user has to carry a large number of tools, has limited access to tools, or cannot maintain close proximity to all of the tools that may be needed to perform a particular task.

It is oftentimes the case that a worker will need to be installing and/or removing fasteners of different types and sizes in rapid succession, and this also frequently occurs in many instances at a time when a worker is not at or near a supply of tools such as a tool box or the like. Further, the worker may need to access other tools like squares, levels, and rulers. These additional tools compound the problems of traditional tools.

For all these reasons as well as others that will become apparent in this disclosure, there is a need for an improved tool set.

SUMMARY

The following presents a summary of this disclosure to provide a basic understanding of some aspects. This summary is intended to neither identify key or critical elements nor define any limitations of embodiments or claims. Furthermore, this summary may provide a simplified overview of some aspects that may be described in greater detail in other portions of this disclosure.

A multi-purpose modular bit assembly is disclosed having a variety of embodiments that may serve a plurality of functions and may improve efficiency and use in comparison to traditional tools. In an embodiment, the bit assembly comprises one or more body members. A body member may comprise a main body that may have a plurality of sides. One or more of the sides may comprise one or more apertures. In another aspect, one or more of the sides may comprise one or more bits disposed on a surface. The bit may comprise one or more bit bodies and one or more bit heads. In an aspect, one or more of the bits may be selectively removable. Body members can be interconnected with each other by inserting the bit of one body member into an aperture of another body member. In an embodiment, the bit assembly may include one or more body members that may comprise end members. Each end member may comprise a plurality of sides, one or more of which may have one or more apertures, and at least one side having a solid surface. The bit assembly can be configured into various shapes by adding, removing, or combining body/end members in different ways. In one embodiment, the bit assembly may be made into a straight design. In another aspect, it can be made an L, an S, a Z, or a T shape.

In at least one embodiment, the body member of the bit assembly may comprise a polygonal prism. One or more sides of the polygonal prism may include one or more apertures and one or more bits on the surface. Further in an embodiment, the polygonal body member may be hexagonal. In at least one aspect, the body member may be a cylinder, one or more sides of which may comprise one or more apertures on its surface and one or more bits thereon.

In an embodiment, one or more apertures on the faces of the body member may be polygonal. For instance, the polygonal apertures may be hexagonal. In at least one aspect, one or more apertures on the faces of the body member may be circular. In an aspect, one or more faces of the body member may also comprise one or more triangle apertures or protrusions.

In at least one embodiment, the bit body may comprise a polygonal prism. The polygonal bit body may be inserted and fitted into an aperture having a corresponding polygonal shape. It is noted that the polygonal bit body may be hexagonal. In embodiments, the bit head may comprise a hardware tool such as a screwdriver head or a drill bit, a writing utensil bit, a cosmetic bit, a toy bit, a lighting bit, a 3C product such as a flash drive, or the like.

According to an embodiment, an end member of the bit assembly may comprise a polygonal prism. One or more sides of the polygonal prism may include one or more apertures on its surface. For example, the polygonal end member may be hexagonal. In at least one aspect, the end member may also comprise a cylinder, one or more sides of which may have one or more apertures on its surface.

In an aspect, the bit assembly may include one or more attachment members which can be attached to one or more body members through the apertures thereon and used to connect those body members to other body members.

The tool assembly can be used to satisfy a variety of purposes, which may be realized by using different bits disposed on the body members. Those bits in the bit assembly may have different bit heads which can serve different functions. The body member may have different indicia or configuration to identify the bit on it.

In at least one embodiment, the bit assembly may comprise sixteen body members, which may be classified into two groups. Each group may include eight body members, two of which may comprise end members. At least one body member in each group may comprise a removable two-head bit thereon.

The following description and the drawings disclose various illustrative aspects. Some improvements and novel aspects may be expressly identified, while others may be apparent from the description and drawings.

DESCRIPTION OF THE DRAWINGS

It is noted that the accompanying drawings illustrate exemplary embodiments of the claimed subject matter and are, therefore, not to be considered limiting of its scope, for it may admit to other effective embodiments.

DETAILED DESCRIPTION OF THE INVENTION

Figure 1:
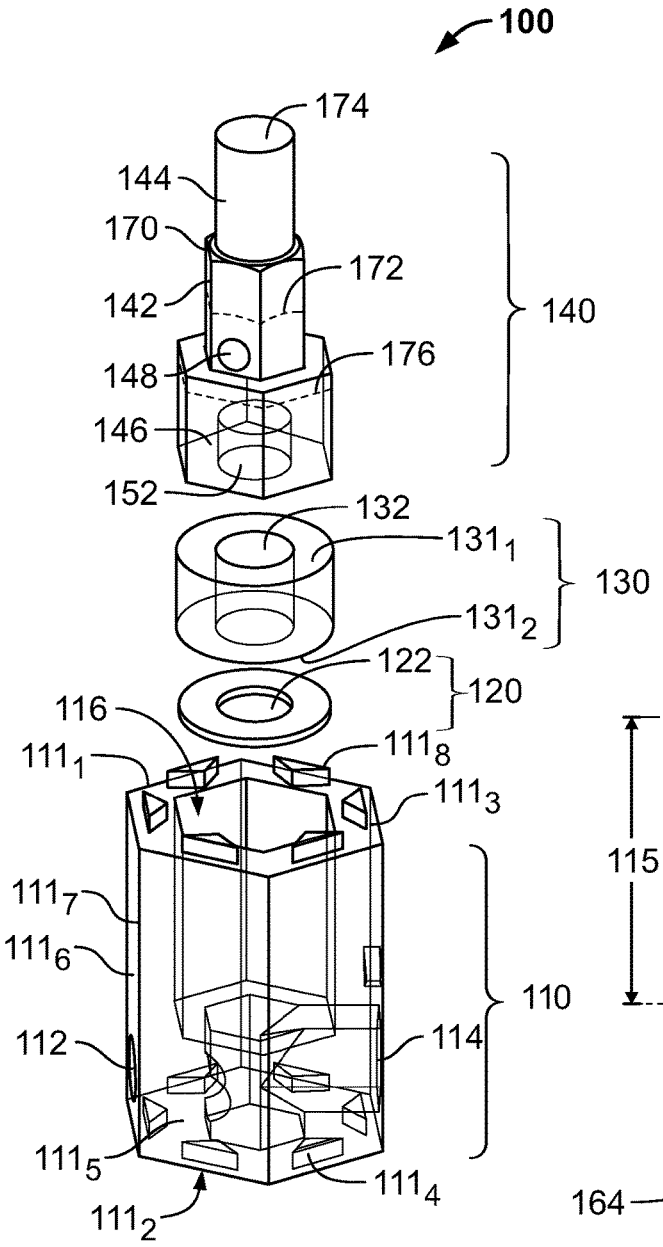
FIG. 1 illustrates an exploded view of a body member.

Reference will now be made to exemplary embodiments, examples of which are illustrated in the accompany drawings. It is to be understood that other embodiments may be utilized and structural and functional changes may be made. Moreover, features of the various embodiments may be combined or altered. As such, the following description is presented by way of illustration only and should not limit in any way the various alternatives and modifications that may be made to the illustrated embodiments. In this disclosure, numerous specific details provide a thorough understanding of the subject disclosure. It should be understood that aspects of this disclosure may be practiced with other embodiments not necessarily including all aspects described herein.

As used herein, the words "example" and "exemplary" mean an instance, or illustration. The words "example" or "exemplary" do not indicate a key or preferred aspect of an embodiment. The word "or" is intended to be inclusive rather than exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggests otherwise.

Various embodiments disclosed herein relate to a multi-purpose modular bit assembly comprising one or more body members. The body member may comprise different shapes, such as a polygonal prism or a cylindrical shape. The body member may comprise one or more sides, one or more of which may comprise one or more apertures on its surface. The body member may further comprise one or more bits. One or more of the bits may be selectively removable. For example, the first bit and the second bit may be removable from the body member. In another example, the first bit may be removable while the second bit may be irremovably secured to the body member. The bit may include one or more bit bodies and/or one or more bit heads. In an embodiment, the body member may comprise a portion which may be used to connect the body member to another body member. In an embodiment, the bit assembly may comprise one or more attachment members which may be attached to the body member and used to connect different body members, such as a magnetic attachment member. In an aspect, the bit assembly may include one or more body members that may comprise end members. For instance, the end members may be similar to other body members but a first side may lack a bit portion and/or a second side may lack an aperture for receiving a body member. In embodiments, the bit assembly may be configured into different shapes by adding, removing, or combining the body members and/or end members to satisfy various functions. The bit assembly may also be used for different purposes by employing body members with specific bits.

In the following detailed description of various embodiments of the invention, terms such as "top," "bottom," "top view," "side view," etc. may be utilized from time to time. It is noted that these descriptive terms are utilized only for simplicity of explanation. As previously noted, in different embodiments of the invention, the body member may comprise a plurality of shapes, some of which may not have a traditional top, bottom, front, rear, or the like. In some instances, for purposes of describing a particular drawing or for the sake of brevity, the terms "top," "bottom," "front," or the like may be used. In such situations, references to a top, bottom, etc. may be replaced with a first side, a second side, etc. Such terms may refer to a relative position as depicted in the illustrations. Thus, embodiments may refer to other sides as a top, bottom, etc. For instance, a top side may be referred to as a bottom side, or the like, depending on the desired vantage point and/or embodiment.

Figure 2:
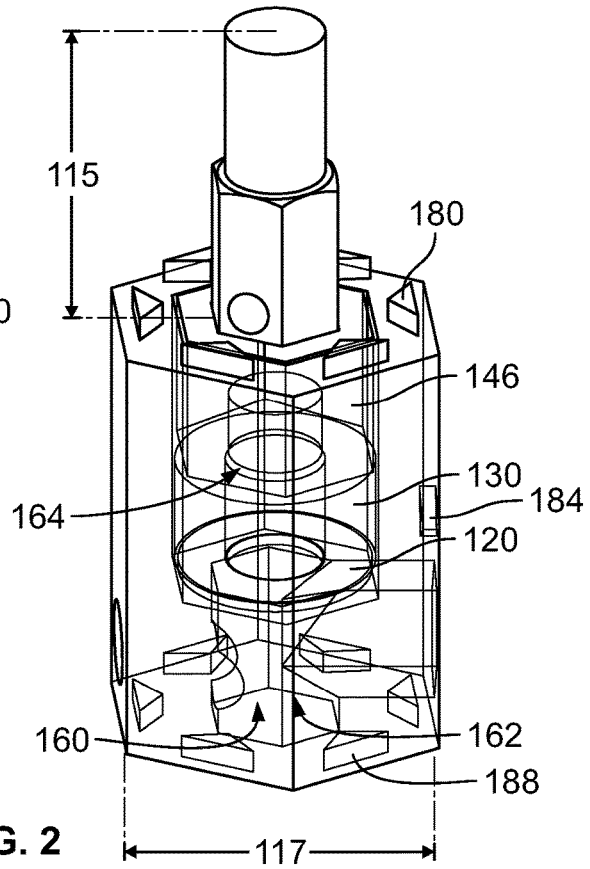
FIG. 2 illustrates a wireframe view of an assembled body member.

Turning to FIGS. 1 and 2, there is a body member 100 according to aspects of this disclosure. FIG. 1 illustrates an exploded view of body member 100 and FIG. 2 illustrates a wireframe view of the body member 100 in an assembled configuration. The body member 100 may comprise a main body 110, a spacer 120, a magnet 130, and/or a bit 140. In an aspect, the body member 100 may be coupled with or comprised by tool assemblies as described herein. While embodiments may refer to a tool assembly or tool assemblies for purposes of explanation, it is noted that such embodiments may not comprise and/or be utilized as a tool. For instance, embodiments may comprise a toy, makeup, or other assemblies.

In an aspect, the body member 100 may be assembled by forming main body 110 with a cavity 116 disposed therein. The cavity 116 may receive the spacer 120, magnet 130, and/or at least a portion of bit 140. For instance, a base portion 146 of bit 140 may be disposed within the cavity 116. Once inserted into or received by the cavity 116, the inserted components may be affixed thereto. For instance, the cavity 116 may be over molded. In another aspect, the main body 110 may be formed (e.g., three-dimensional printing, chemical deposition, etc.) or molded around the spacer 120, magnet 130, and/or at least a portion of the bit 140. It is noted that the body member 100 may be formed or assembled according to other appropriate methods. It is further noted that the various components of body member 100 may comprise a monolithic construction and/or may be attachably (e.g., removably or irremovably) assembled. Moreover, it is noted that body member 100 may comprise a different number of components. For instance, the body member 100 may comprise a different number of spacers (e.g., 0, 2, 3, etc.). The body member 100 may also comprise more than one bit.

The bit 140 may comprise a bit body 142, bit base 146 and bit head 144. The bit body 142 may extend from bit base 146 towards bit head 144. Bit head 144 may extend from a proximal end (e.g., proximal to bit body 142) to a distal end (e.g., distal from bit body 142). In an aspect, the bit head 144 may comprise a bit selected for an appropriate purpose. For instance, the bit head 144 may comprise a tool bit such as a screw driver head as depicted herein. It is noted that bit head 144 may comprise other types of bits, such as a drill bit, socket bits magnetic bit, writing utensil, makeup, toy, light (e.g., light emitting diode (LED)), key, brush, flash drive, or the like. In another aspect, the bit head 144 may be operatively connectable with other types of bits. For example, a socket bit may be attached to a screwdriver head or other appropriate bit. The bit body 142 may comprise a pin 148. Pin 148 may be configured to lock the bit body 142 into place when body member 100 is attached to another body member, as described herein. While bit body 142 and bit base 146 are illustrated as generally hexagonal prisms, it is noted that the bit body 142 and bit base 146 may comprise other shapes.

In an aspect, a cross-sectional length 174 of the bit head 144 may be about equal to or less than a cross-sectional length 172 of the bit body 142. In another aspect, a cross-sectional length 172 of the bit body 142 may be about equal to or less than a cross-sectional length 176 of the bit base 146. For example, cross-sectional length 174 of the bit head 144 may be smaller than cross-sectional length 172 of bit body 142, which may be smaller than the cross-sectional length 176 of bit base 146. In an aspect, the increasing cross-sectional lengths (e.g., from bit head 144 to bit base 146) may allow for altered (e.g., improved) structural integrity. For instance, the larger cross-sectional length 176 of bit base 146 may allow bit base 146 to serve as an anchor or counter weight and thereby secure the bit 140 with main body 110.

In at least one embodiment, the bit 140 may comprise more than one bit head. For example, the bit 140 may comprise two bit heads. When the bit 140 comprises more than one bit head, it may include the same number of bit bodies as that of bit heads. Each bit head may be disposed on a separate bit body and extend from a proximal end of the bit body to a distal end of the bit body. For instance, the bit 140 may comprise one bit base and two bit bodies. The two bit bodies may be disposed on different sides of the bit base. One of the bit bodies may extend from the bit base to one bit head. The other bit body may extend from the bit base to another bit head. In an aspect, the bit 140 may include less bit bodies than bit heads. And at least two bit heads may share one bit body. When a bit 140 having more than one bit head is assembled into the main body 110, one or more of the bit heads may be inserted into the main body 110 and fixed thereto. In an embodiment, the bit 140 may be removable from the main body 110. And the bit 140 may be assembled into the main body 110 by inserting different bit heads of bit 140 into main body 110, such that each of the bit heads may be exposed and utilized.

Figure 17:
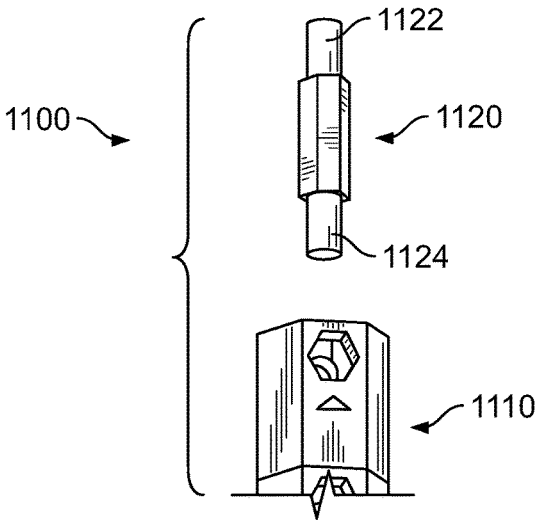
FIG. 17 shows a side view of a body member comprising a removable two-head bit.

FIG. 17 illustrates a body member 1100 comprising a removable bit. As shown in FIG. 17, the body member 1100 may comprise a main body 1110 and a bit 1120. The bit 1120 may comprise a two-head bit and/or may be disassembled from the main body 1110. For example, when the bit head 1124 gets worn out, the bit 1120 may be removed and re-attached to main body 1110 by inserting bit head 1124 into the main body 1110. Then the bit head 1122 may be exposed and utilized. The bit 1120 may also be removed and replaced by another bit as a whole.

Main body 110 may comprise an N-sided polygonal prism, where N is a number. For example, main body 110 may comprise a hexagonal prism, rectangular prism, or the like. It is noted that main body 110 may comprise other shapes or configurations, such as a frustoconical shape, hourglass shape, irregular shape, ergonomically configured shape, or the like. It is further noted that when main body 110 comprises a polygonal prism, it may include sharp edges, as shown in FIG. 1. In an aspect, edges of main body 110 may be beveled, chamfered, tapered, or the like. In at least one embodiment, the main body 110 may comprise a generally cylindrical shape. According to an embodiment, the main body 110 may comprise gripping features formed on or in a surface. For instance, the main body 110 may comprise ribs or ridges that may allow a user to easily grip the main body 110. The main body 110 may be made of various materials, such as metallic, plastic, glass, rubber, stone, or wooden materials. For instance, main body 110 may be comprised of an aluminum alloy. In an aspect, the main body 110 may comprise a handle of the body member and/or a portion of a handle of a bit assembly.

In an embodiment, main body 110 may comprise one or more sides, one or more of which may comprise one or more apertures. For example, main body 110 may comprise sides $\mathbf{111}_{1\text{-}8}$. For sake of brevity, side $\mathbf{111}_1$ may be referred to as top side $\mathbf{111}_1$ while side $\mathbf{111}_2$ may be referred to as bottom side $\mathbf{111}_2$. Side $\mathbf{111}_6$ may comprise an aperture 112. The aperture 112 may be appropriately shaped or sized to receive bit head 144 and/or other components (e.g., an attachment member). For instance, the aperture 112 may be generally circular or conical in shape and may be sized to receive bit head 144. In another aspect, the aperture 112 may be sized such that bit body 142 may not be inserted into the aperture 112. In at least one embodiment, side $\mathbf{111}_3$ may comprise an aperture 114. The aperture 114 may be appropriately sized and shaped to receive a portion of another body member, such as a bit body of a body member. For instance, the aperture 114 may be hexagonally shaped and may comprise an inner perimeter that is similar in size and shape to the perimeter of bit body 142. In at least one embodiment, one or more sides of main body 110 may contain one or more triangular apertures, such as apertures 184 and 188. Further in an embodiment, one or more sides of main body 110 may include one or more triangular pegs 180. It is noted that the triangular apertures 184 and 188 may be utilized to receive the triangular pegs 180 and form a tight fit when two or more body members are interconnected. The fit between the triangular apertures 184 or 188 and pegs 180 may further stabilize the bit assembly and prevent the body members from slipping with respect to each other. It is noted that the apertures and pegs noted above may comprise other appropriate shapes.

In an aspect, the apertures 112 and 114 may be generally coaxial with each other. In another aspect, the apertures 112 and 114 may intersect with chamber 160 of bottom end $\mathbf{111}_2$. For instance, bit body 142 may be inserted into aperture 114 such that bit head 144 may extend through to aperture 112. In another aspect, the height or length 115 of the exposed portion of bit 140 (e.g., bit body 142 and bit head 144) may be generally equal to or less than a length 117 of coaxial apertures 112 and 114. For example, the exposed portions of a bit (e.g., a bit similar to bit 140) may be inserted through the apertures 114 and 112 such that a distal end of the bit head does not protrude from aperture 112. It is noted that the exact dimensions (e.g., shapes, sizes, etc.) of the apertures 114 and 112 may depend at least in part on the desired sizes of the bit head 144 and bit body 142. Other shapes may be utilized within the scope and spirit of this disclosure, such as a circular aperture, a triangular aperture, etc.

Spacer 120 may be made from nylon, rubber, or any other appropriate materials. In an aspect, the spacer 120 may comprise a material that may be compressed. In an example, the spacer 120 may be compressed during construction to allow a portion of the bit 140 to be level with upper end $\mathbf{111}_1$. For instance, bit base 146 may be inserted into the cavity 116. The bit base 146 may be adjusted such that the bit base 146 is level or coplanar with upper end $\mathbf{111}_1$. The magnet 130 may be configured in different shapes. In an embodiment as shown in FIG. 1, the magnet 130 may comprise a frame-like shape, such as a ring shape. In an aspect, the magnet 130 may include a south pole and a north pole. For example, the top-facing side $\mathbf{131}_1$ of magnet 130 may comprise a north pole, and the bottom-facing side $\mathbf{131}_2$ of magnet 130 may comprise a south pole, or vice versa. The magnet 130 may magnetize the bit 140. It is noted that the magnetic force of the bit 140 may be weaker than that of the magnet 130.

The spacer 120 and magnet 130 may comprise apertures 122 and 132. In another aspect, bit base 146 may comprise a cavity 152. When body member 100 is assembled, the apertures 122/132 and the cavity 152 may be generally aligned or coaxial with each other and/or with an opening to chamber 160 at the bottom end $\mathbf{111}_2$. The apertures 122/132 and cavity 152 may form a chamber 160. The chamber 160 may be defined by a lower chamber 162 and an upper chamber 164, which may generally comprise apertures 122/132 and cavity 152. In an aspect, the perimeter or the lower chamber 162 may be generally larger than that of upper chamber 164. For instance, the lower chamber 162 may be sized and shaped to receive bit body 142 and the upper chamber 164 may be sized and shaped to receive bit head 144. For instance, the bit head 144 and the bit body 142 may each be received by chambers sized and shaped to provide a tight fight.

The spacer 120 may comprise a material that may be deformable. For instance, the bit 140 may comprise a circular groove 170. When the bit 140 is pushed through a chamber 160, the spacer 120 may be deformed by the bit head 144. As the bit head 144 passes through the upper chamber 164 into a final position, the spacer 120 may snap or click into circular groove 170. Once connected, the spacer 120 may snap or click out of the circular groove when a user pulls body members apart. In an aspect, the spacer 120 and circular groove 170 may allow for a secure or altered (e.g., improved) connection.

Figure 3:
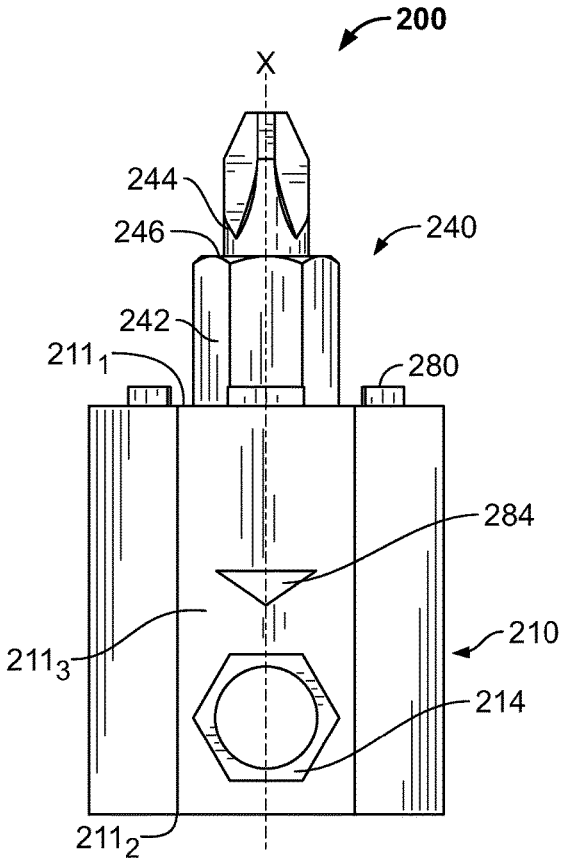
FIG. 3 illustrates a side view of a body member.
Figure 6:
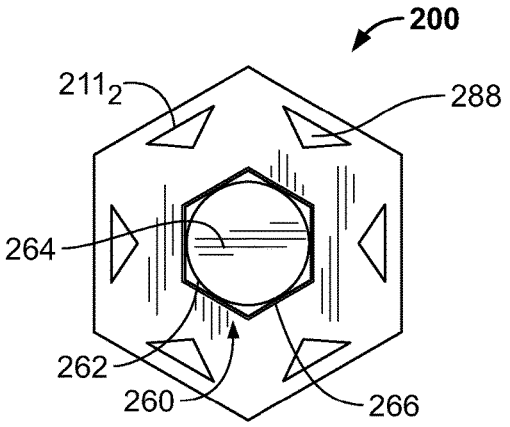
FIG. 6 shows a bottom plane view of a body member.

FIG. 3 illustrates a side view of an exemplary embodiment of a body member 200 in accordance with various disclosed aspects. The body member 200 may comprise a main body 210 and a bit 240. The bit 240 may include a bit body 242 and/or a bit head 244. Various components of body member 200 may comprise a monolithic construction and/or may be separately constructed. For instance, bit 240 and main body 210 may be monolithically constructed or may be separately constructed and attachably (e.g., removably or irremovably) assembled. It is noted that components of body member 200 may generally comprise similar aspects and/or functionality as described with reference to components of the body member 100. For instance, body member 200 may comprise a magnet similar to magnet 130. In another aspect, main body 210 may comprise similar aspects as main body 110. For instance, main body 210 may comprise a chamber 260 as shown in FIG. 6, which may be comprised of an upper chamber and a lower chamber.

The bit body 242 may comprise various shapes. In an aspect, the bit body 242 may be an M-sided polygonal prism, where M is a number. As illustrated in FIGS. 3-8, bit body 242 may comprise a hexagonal prism. It is noted that the bit body 242 may be any other shapes, such as cylindrical, conical, hour glass-shapes, spiral shapes, ergonomically configured shapes, irregular shapes, or the like. In an aspect, the shape may depend on the intended application of the tool and/or a desired configuration. In another aspect, the bit body 242 may comprise an edge 246. The edge 246 may be crowned, beveled, chamfered, tapered, or the like.

Bit 240 may extend or protrude from a distal end $\mathbf{211}_1$ (e.g., a top end or top side) of the main body 210. The bit body 242 and bit head 244 may be configured in a way that the bit 240 may be inserted into a chamber (e.g., similar to chamber 260) of another body member. Likewise, chamber 260 may be configured to receive at least a portion of a bit 240. For instance, chamber 260 may comprise a shape that generally corresponds to the shape of the bit body 242. In an aspect, the chamber 260 may include a chamber opening 266 disposed on a proximal end $\mathbf{211}_2$ (e.g., bottom end or bottom side) of main body 210. The chamber opening 266 may comprise a shape similar to that of bit body 242. For example, the chamber opening 266 may comprise a hexagonal aperture that opens into lower chamber 262. Lower chamber 262 may comprise a hexagonal prism shape similar to that of bit body 242. In another aspect, the lower chamber 262 and/or chamber opening 266 may be about equal to and/or greater in size than the perimeter of the bit body 242. For instance, when a bit body 242 is inserted into the chamber 260, the bit body 242 may press radially towards the lower chamber 262. In another aspect, the bit head 244 may be inserted into the upper chamber 264 such that an exposed portion of the bit 240 is fully encompassed by the chamber 260. When fully inserted, a distal end of a bit may contact and/or may be parallel with the proximal end $\mathbf{211}_2$.

In at least one embodiment, main body 210 may comprise a plurality of sides. A first side $\mathbf{211}_3$ of the main body 210 may comprise a first side of the main body 210. For instance, the main body 210 may comprise a hexagonal prism or other shapes as described herein. In at least one embodiment, main body 210 may contain a plurality of edges. In an aspect, the edges of main body 210 may be sharp. In another aspect, they may be chamfered, beveled, or tapered. The first side $\mathbf{211}_3$ may comprise an aperture 214. The aperture 214 may be disposed at various positions along the first side $\mathbf{211}_3$. In an aspect, the aperture 214 may be disposed proximal to proximal end $\mathbf{211}_2$. In another aspect, the aperture 214 may be disposed such that it is below the upper chamber 264 and/or intersects with lower chamber 262. As depicted the aperture 214 may comprise a hexagonal shaped opening. It is noted that aperture 214 may comprise other shapes as described herein. A second side $\mathbf{211}_4$ may comprise an aperture 212. The aperture 212 may generally comprise a cylindrical opening that may be coaxial with aperture 214 and/or orthogonal to the chamber 260. In an aspect, the aperture 212 may be disposed proximal to proximal end $\mathbf{211}_2$, such as below upper chamber 264. The perimeter or circumference of the aperture 212 may be generally smaller than the perimeter of the aperture 214. For instance, the bit 240 may be inserted into the aperture 214. In an example, a user may insert a bit (e.g., bit 240) into the aperture 214. The user may press the bit 240 such that the bit 240 is fully inserted. When fully inserted, the bit body 242 may be disposed with the aperture 214 (and/or at least a portion of the lower chamber 262). The bit head 244 may be disposed with the aperture 212 (and/or at least a portion of the lower chamber 262).

In another example, the user may insert the bit 240 in the aperture 212. The aperture 212 may be an appropriate size to receive the bit head 244 and/or another component (e.g., such as an attachment member depicted in FIG. 8). In another aspect, the aperture 212 may be further configured such that bit body 242 may not be inserted into the aperture 212. For instance, the aperture 212 may comprise a perimeter that is smaller than that of bit body 242 but larger or generally equal to that of bit head 244.

It is noted that the main body 210 may comprise a different number of apertures and/or differently shaped apertures. In another aspect, the apertures may have disparate shapes than the bit body 242 and/or bit head 244. As an example, the bit body 242 may comprise a hexagonal prism shape and an aperture of another body member may comprise a rectangular shape. The apertures may be disposed on the same or on different sides of the main body 210. It is noted that different apertures 212 may comprise generally the same, similar, or different shapes. In another aspect, the apertures 212 may comprise generally the same, similar, or different dimensions.

In at least one embodiment, main body 210 may comprise one or more triangular apertures or pegs. The triangular apertures or pegs may be disposed on different sides of main body 210. As shown in FIG. 3, side $\mathbf{211}_3$ may comprise a triangular aperture 284. The aperture 284 may be disposed in various positions along side $\mathbf{211}_3$. It is noted that the triangular apertures and pegs may be disposed on other sides of the main body 210.

Figure 4:
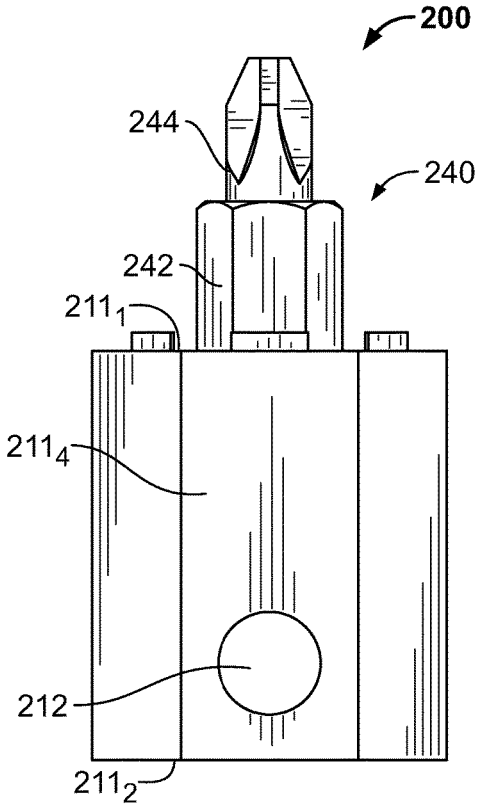
FIG. 4 shows another side view of a body member.
Figure 5:
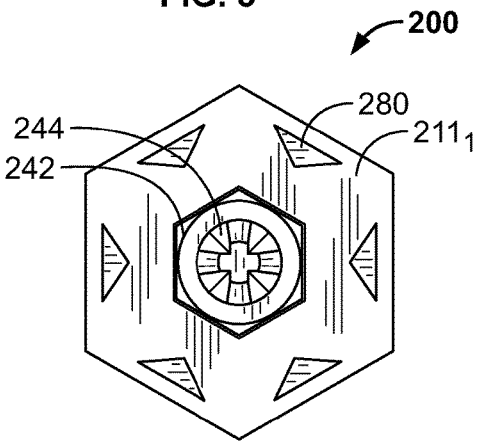
FIG. 5 illustrates a top plane view of a body member.

In an aspect, there may be more than one aperture or peg on one side of main body 210. For instance, as shown in FIG. 6, there may be six triangular apertures 288 disposed on side $\mathbf{211}_2$. The six apertures 288 may be disposed uniformly along the periphery of side $\mathbf{211}_2$. It is noted that the apertures may not be disposed uniformly and may be in various positions along the side $\mathbf{211}_2$. In FIGS. 3-5, the side $\mathbf{211}_1$ may comprise six triangular pegs 280 on its surface. When two body members 210 are connected together by inserting bit 240 into chamber 260, the apertures 288 on side $\mathbf{211}_2$ of one body member may receive the pegs 280 on side $\mathbf{211}_1$ of the other body member. The same effect may occur when bit 240 is inserted into the aperture 214. Aperture 284 on side $\mathbf{211}_3$ may receive one of the pegs 280 on side $\mathbf{211}_1$. The structure of the bit assembly after two or more body members are connected may be stabilized.

It is noted that the apertures (e.g., aperture 284) and pegs (e.g., peg 280) may not be triangular. They may comprise any appropriate shapes. It is further noted that different apertures/pegs may comprise generally the same shape, similar, or different shapes. In another aspect, the apertures/pegs may comprise generally the same, similar, or different dimensions. In an embodiment, the aperture 284 may comprise a shape and dimension that it does not intersect with chamber 260. In another aspect, the apertures 288 may comprise a shape and dimension that they do not intersect with aperture 214 or 212 or chamber 260.

The bit head 244 can be chosen from a variety of types of heads that may be associated with a particular purpose. As illustrated in FIGS. 3-8, the bit head 244 may comprise a Phillips screwdriver head. According to embodiments, the bit head 244 may be a drill bit, a writing utensil bit, a light (e.g., light emitting diode or LED) bit, a cosmetic bit, a toy bit, an electronic (e.g., flash drive, computer/communications/consumer (3C) product, etc.) bit, or the like. In embodiments comprising an LED or other electronic bits, the main body 210 may comprise a power source, such as a battery.

In at least one embodiment, the body member 200 may comprise an identifier that indicates a property of the bit 240. The identifier may include shape, color, and/or other indicia, such as printed marking, etch markings, raised markings, markings adhered to the body member 200, textual or pictorial markings, or the like. For example, when a bit assembly of a plurality of body members is connected, it may be difficult for a user to determine what type of bit a particular body member comprises. A user may have to dissemble the body members one by one to find the type of bit for which she is looking. In at least one embodiment, the material being utilized to make the main body 210 may be specially chosen to identify, indicate, or distinguish the bit 240. For example, wood or plastic may be utilized for body members that have writing utensil bits. And metal may be employed when the bit on the body member is a hardware tool bit. In an aspect, a color of the body member 200 may be configured to identify the specific bit 240 on the body member. For example, where the bit head 244 is a cosmetic bit or a crayon, the main body 210 and/or the bit body 242 may have the same or a similar color as that of the bit head 244. Further, in an aspect, the main body 210 may be transparent and/or partially opaque such that the bit 240 may be visible when the bit 240 is inserted within an aperture of another body member.

In an embodiment, the indicia may comprise markings or the like that may be useful for a desired application. For instance, when body member 200 is utilized as a tool, the indicia may comprise markings for measurements similar to a ruler. In another aspect, the indicia may comprise conversion tables, charts, or the like.

It is noted that the body member 200 may comprise indicia that identifies the type of bit 240. In an example, where the bit head 244 is a screwdriver head, the body member 200 may comprise indicia identifying the type of the screwdriver head fixed onto it, such as a "+" mark for a Phillips head or a "–" mark for a standard flat head. It is noted that the indicia may be printed, molded, etched, adhered to, or otherwise disposed on or in the body member 200. In another example, the indicia may include a numerical value that identifies a property of the bit 240. For instance, the indicia may include a size (e.g., diameter, circumference, etc.) of a drill bit that comprises the bit head 244.

FIG. 5 shows a top view of the body member 200 in accordance with various described aspects. In FIG. 5, the axis X of the bit 240 is perpendicular to the distal end $\mathbf{211}_1$. In at least one embodiment, the angle between the axis X of the bit 240 and the distal end $\mathbf{211}_1$ may be some other than 90°, such as an acute or obtuse angle. As shown In FIG. 5, the bit 240 is illustrated as being located in about the center of the third distal end $\mathbf{211}_1$. It is noted that the bit 240 may be disposed in a position on distal end $\mathbf{211}_1$ that is not its center. It is further noted that the distal end $\mathbf{211}_1$ may comprise a shape that may not comprise a regular center.

FIG. 6 shows a bottom plane view of the body member 200. In at least one embodiment, the proximal end $\mathbf{211}_2$ may be generally parallel with distal end $\mathbf{211}_1$. In another aspect, a plurality of sides of the main body 210 may be generally perpendicular with proximal end $\mathbf{211}_2$ and/or the distal end $\mathbf{211}_1$. It is noted that the proximal end $\mathbf{211}_2$ and the distal end $\mathbf{211}_1$ may be other than parallel. For example, one of the proximal end $\mathbf{211}_2$ or the distal end $\mathbf{211}_1$ may be at an angle other than 90 degrees with the axis X, while the other of the ends may be perpendicular to the axis X. As illustrated in FIG. 6, the proximal end $\mathbf{211}_2$ may comprise the chamber opening 266. In at least one embodiment, the chamber opening 266 may be disposed or formed generally in the center of side $\mathbf{211}_2$. In an aspect, proximal end $\mathbf{211}_2$ may be configured to include a different number of apertures (e.g., 0, 2, 3, etc.) or differently shaped, positioned, and/or sized apertures. For instance, side $\mathbf{211}_2$ may comprise a plurality of triangular apertures 288. It is noted that the body member 200 may comprise an end member and side $\mathbf{211}_2$ may be generally flat without any apertures.

Figure 7:
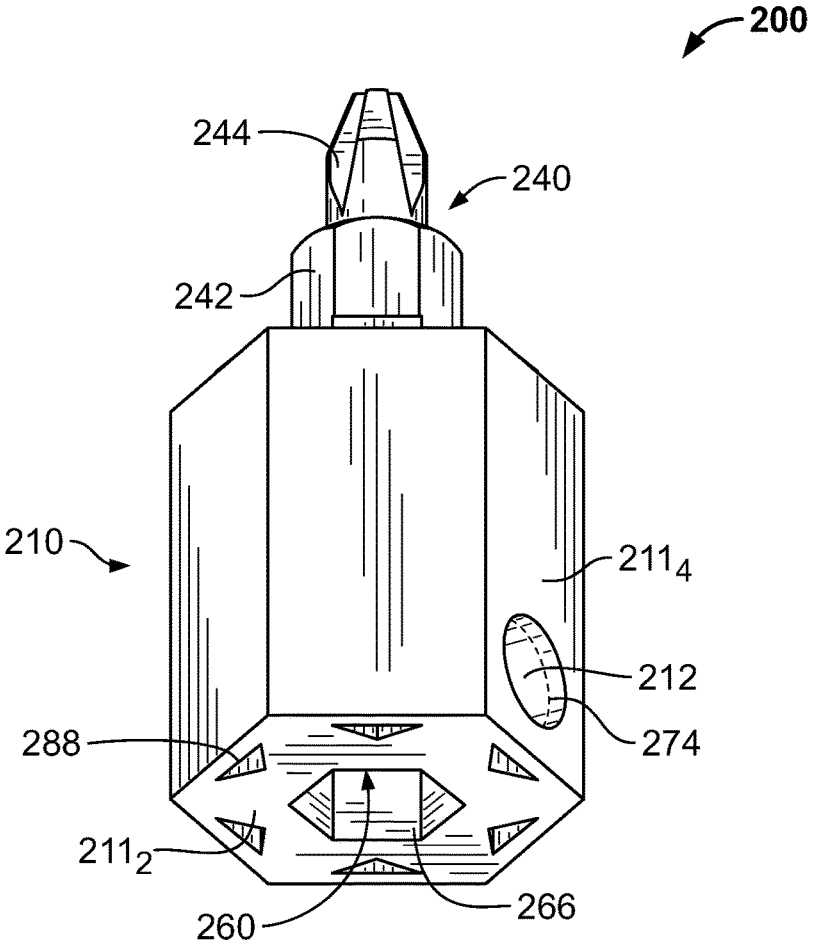
FIG. 7 shows a perspective view of a body member.

FIG. 7 shows a perspective view of the body member 200. From FIG. 7, we can see the relative positions and locations of different components of the body member 200. Body member 200 may comprise a main body 210 and a bit 240. The main body 210 may comprise a plurality of shapes. In FIG. 7, the main body 210 is illustrated as a hexagonal prism. One or more sides of the main body 210 may comprise one or more apertures on its surface. In FIG. 7, proximal end $\mathbf{211}_2$ comprises a hexagonal aperture 266 and six triangular apertures 288. And second side $\mathbf{211}_4$ comprises an aperture 212. Those apertures may comprise the same or different shapes and/or sizes. For example, in FIG. 7, aperture 212 is circular and aperture 266 is hexagonal. The apertures may receive a bit of another body member or be used in any other way to connect the body member 200 to another body member. For example, aperture 266 in FIG. 7 may receive a bit of another body member whose bit body is hexagonal. One side of main body 210 may include a bit 240 protruding therefrom. It is noted that main body 210 may include more than one bits disposed on one or more of its sides.

Figure 8:
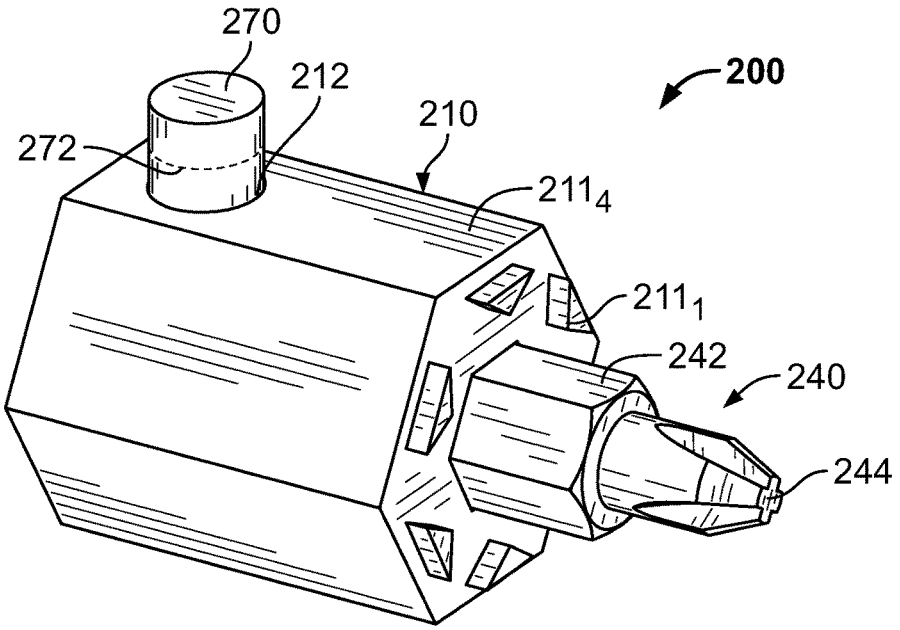
FIG. 8 illustrates a perspective view of a body member having an attachment member attached thereto.

FIG. 8 illustrates a perspective view of body member 200 that may comprise or be coupled with an attachment member 270. In embodiments, a bit assembly may comprise a plurality of body members 200 and one or more attachment members 270. The attachment member 270 may be utilize to connect the body members and/or to attract (e.g., hold) objects. In an aspect, the attachment member 270 may be a peg or other insert that may be inserted into an aperture of body member 200, such as aperture 212 (as depicted), aperture 214, or the like. The attachment member may be a variety of shapes, such as a polygonal shape, a cylindrical shape, etc. As such, the attachment member 270 may be attached or coupled to the body member 200. In another aspect, the attachment member 270 may have a perimeter 272 that may be similar in shape to and may be about equal to, larger than, or less than a perimeter 274 of the aperture 212. The attachment member 270 may be attached to those apertures through mechanical nesting. For instance, a user may insert attachment member 270 into aperture 212. The attachment member 270 may press radially towards the perimeter 274 of the aperture 212 to create a snug or tight fight, which may secure the attachment member 270 within the aperture 212. It is noted that, the attachment member 270 may be fixed to the body member through different mechanisms, such as via threads, cleats, pins, magnets, or the like. In another example, the attachment member 270 may connect two body/end members through the use of clip, screw, etc. It is further noted that the attachment member 270 may not be an independent piece. It may be an irremovably constituent part of the body member 200. For example, it may be a protuberant shaped portion and it may be used to connect the body member 200 to another body/end member through an aperture thereon.

The body member 200 may be connected to another body member by attaching the attachment member 270 to a second body member. In at least one embodiment, the attachment member 270 may be attached to one or more of the body members being connected by inserting the attachment member 270 into an aperture on the body member. As an example, the attachment member 270 may be inserted into aperture 212, as illustrated in FIG. 8. It is noted that, when attached, the attachment member 270 may generate an indication that it is fully or properly inserted, such as an audible or tactical click.

In an example, the attachment member 270 may allow the body member 200 and/or other body members to be connected at angles other than 90 degrees or in straight lines. For instance, a plurality of attachment members 270 may be configured in an "A-frame" shape. This may allow a user to utilize a tool assembly as a compass for drawing curves (e.g., circles) or measuring an angle. In an aspect, the main body 210 may comprise indicia that may allow a user to determine an angle based on relative positions of body members.

According to embodiments, attachment member 270 may be fully inserted into the aperture 212 such that at least a portion of the attachment member 270 is disposed within a chamber (e.g., chamber 260). This may place the body member 200 and/or chamber 260 in a locked configuration, such that a bit 240 may be blocked from being inserted into the chamber 260. In an aspect, to unlock the body member 200 and/or chamber 260, a user may push the attachment member 270, such as via a bit of another body member, out of the chamber 260.

The attachment member 270 may comprise a magnet. In embodiments where the attachment member 270 comprises a magnet, the magnet may contribute to securing the attachment member 270 in an aperture and/or securing the body member 200 to another body member. For instance, the attachment member 270 may be attracted to a magnetic member of another body member (e.g., a bit, a magnet disposed therein, etc.). In another aspect, a user may utilize the magnet to hold or attract objects. For instance, a user may attach screws, bolts, nails, or other objects with metallic properties to the attachment member 270. This may provide the user with a convenient position for storing hardware. It is noted that the user may also attach metallic objects to the main body 210 via a magnetic force of an internal magnet (e.g., magnet 130). It is noted that the attachment member 270 may be attached to the body member 200 at positions other than within the aperture. For example, when the attachment member 270 and the body member 200 both contain magnetic materials, the attachment member 270 may be attached to the main body 210, the bit body 242, or the bit head 244 of the body/end member. It is further noted that the attachment member 270 may comprise magnetic or non-magnetic materials. For instance, the attachment member 270 may comprise various materials, such as plastic, metal, wood, glass, or other materials. In another aspect, the attachment member 270 may be configured in different shapes, such as cylinders, polygons, irregular shapes, or the like. In an example, the attachment member 270 may comprise a corresponding shape and size as those of the apertures to which it may be attached.

While embodiments generally described body members as being attachable to or with other body members, it is noted that body members may be attached to other systems or devices. For instance, a body member 200 may be configured to attach to a power drill. In an example, a bit on the power drill may be inserted into a chamber 260 to allow the body member 200 to be attached to a power drill. In another aspect, a protrusion may extend from the body member 200 to allow for attachment to the power drill. In another aspect, when the body member 200 comprises two bits, one of the bits may be connected to the external power drill, the other bit may be utilized for its intended purpose, or be utilized to connect to other body members.

Figure 16B:
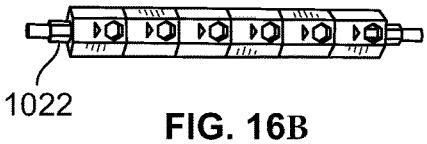
FIG. 16B shows a side view of a set of the body of FIG. 16A with an insert bit.
Figure 16A:
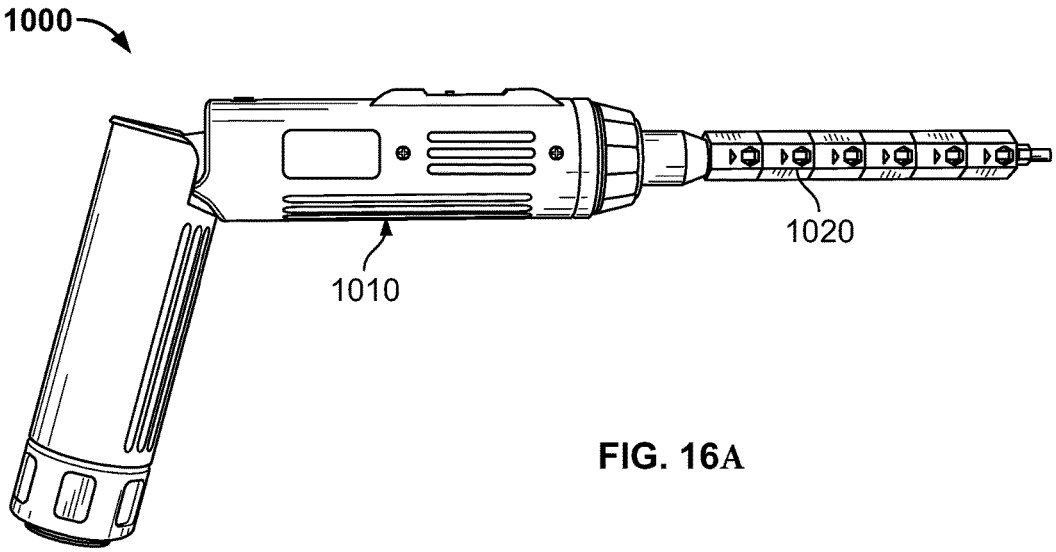
FIG. 16A shows a side view of a set of body members being connected to a power tool.

FIG. 16A shows a bit assembly being connected to an external power tool. As illustrated in FIG. 16A, the body member 1020, which have similar characters as the body members described above (e.g., body member 100), may be connected to power tool 1010 by inserting a bit 1022 (as shown in FIG. 16B) of body member 1020 into a receiving opening of power tool 1010. It is noted that the body member 1020 may be connected to other body members to extend the length of the tool. It is noted that the body member 1020 may be connected to an external system or device through any other appropriate mechanisms. It is noted that the body member 1020 may be attached to other objects or devices, such as electronic tooth brushes, drill presses, writing utensils, or the like.

Figure 9:
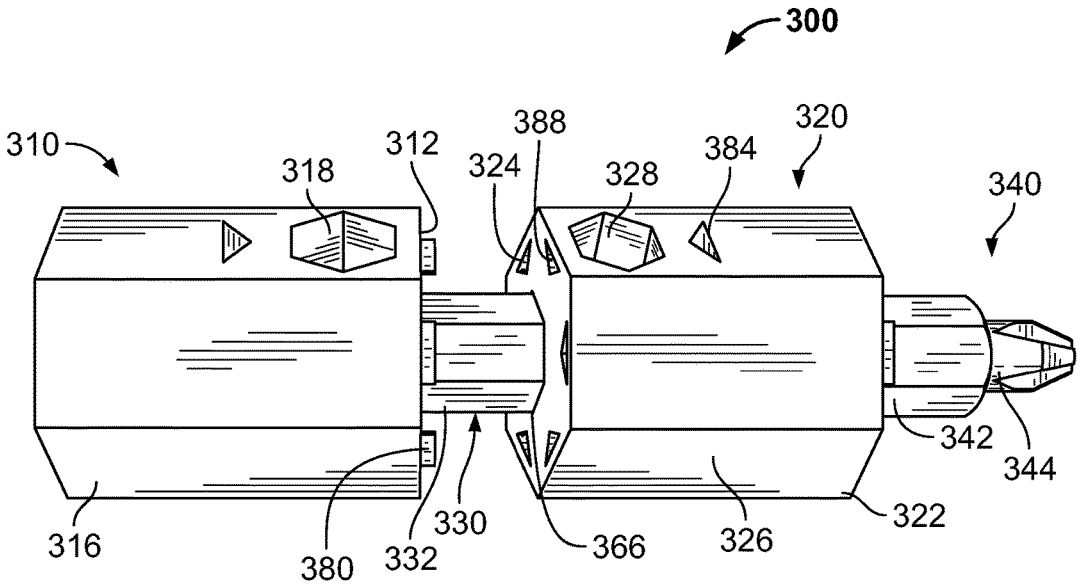
FIG. 9 illustrates a perspective view of two body members that may be connected.

FIG. 9 illustrates a side view of a tool assembly 300 in accordance with various disclosed aspects. The tool assembly 300 may comprise a first body member 310 and a second body member 320. The first and second body members 310 and 320 may comprise substantially similar aspects as body members described with reference to the other figures (e.g., body member 200). It is noted that tool assembly 300 may comprise a different number of body members and/or differently configured body members. For instance, the tool assembly 300 may comprise a hexagonal body member and/or cylindrical body member. In an aspect, first and second body members 310 and 320 may comprise identical or similar body members. Body members 310 and 320 may be substantially similar except for comprising different bit heads and/or different apertures (e.g., different positions or dimensions of apertures). For instance, body member 310 may comprise a bit 330 extending from a distal end 312. The bit 330 may include a bit body 332 and a bit head. The bit head of the body member 310 is illustrated as being inserted into a chamber opening 366 on proximal end 324 of body member 320. Body member 320 may comprise a bit 340 extending from distal end 322, which may comprise a bit body 342 and a bit head 344. The bit head 344 may be a Phillips head screwdriver having a particular size. The bit head of the bit 330 may comprise a disparate head or type of head (e.g., different sized Phillips head screwdriver, flat head screwdriver, etc.).

According to embodiments, body member 310 and body member 320 may be coupled together. For instance, bit 330 of body member 310 may be inserted into a chamber of the body member 320. In an aspect, the chamber opening 366 may open into the cavity. The shape and dimensions of the chamber and/or chamber opening 366 may be configured to receive the bit 330. For example, the shape of the bit body 332 may be similar to the shape of the cavity. In an aspect, the bit 330 (and/or magnet within the main body 316) may be attracted to a magnet within the main body 326. The magnetic attraction may secure the body member 310 and 320 when attached. In another aspect, the distal end 312 of body member 310 may comprise one or more triangular pegs 380. The proximal end 324 of body member 320 may comprise one or more triangular apertures 388. These triangular apertures may not intersect with aperture 328. When the body member 310 and 320 are attached, the triangular apertures 388 on proximal end 324 may receive the triangular pegs 380 on side 312 and further stabilize the bit assembly 300. It is noted that the apertures and/or pegs on proximal end 324 and 312 may be any appropriate shapes or dimensions.

It is noted that body members may be connected by utilizing various connecting mechanisms. In an embodiment, connecting different body members may be realized by using magnetic force, mechanical nesting (e.g., bit body 332 may press radially towards the chamber of body member 320), threaded members (e.g., bit body 332 may be threaded and the chamber may comprise an appropriate female threaded member), clips, pins (e.g., as shown in FIGS. 1 and 2), or the like. It is further noted that the body members 310 and 320 may indicate a complete connection and/or disconnection via an audible or tactile "click".

In another aspect, body members 310 and 320 may respectively comprise hexagonal prism main bodies 316 and 326. The main bodies 316 and 326 may comprise one or more apertures. For example, main body 316 may comprise an aperture 318 and main body 326 may comprise an aperture 328. Apertures 318 and 328 may comprise hexagonal apertures. Aperture 318 may be disposed proximal to distal end 312. In another aspect, aperture 328 may be disposed proximal to proximal end 324. It is noted that main body 316 and main body 326 may comprise a different number of apertures and/or differently configured apertures. In another aspect, the apertures 318 and/or 328 may have a corresponding shape and size as that of a bit of body members. As shown in FIG. 9, aperture 318 may comprise a hexagonal shape. Bit body 342 may also comprise a hexagonal prism. In an aspect, the perimeter of bit body 342 may be slightly smaller than or equal to the perimeter of aperture 318. It is noted that the receiving aperture and the inserted bit may comprise disparate shapes, such as a rectangle and a hexagonal prism. In this instance, the shape and size of the aperture 318 and the bit body 342 may be specifically configured to allow the bit 340 able to be inserted into the aperture 318. It is noted that the body members may indicate proper connection through various ways, such as visible fit or a tactile or audible click. The bit assembly 300 may comprise various structures or shapes, depending on the number and the respective configuration of the constituting body members and the way they are connected. In FIG. 9, two body members 310 and 320 are forming a straight head-to-end design. In an aspect, at least one of the body members may be an end member.

Figure 10:
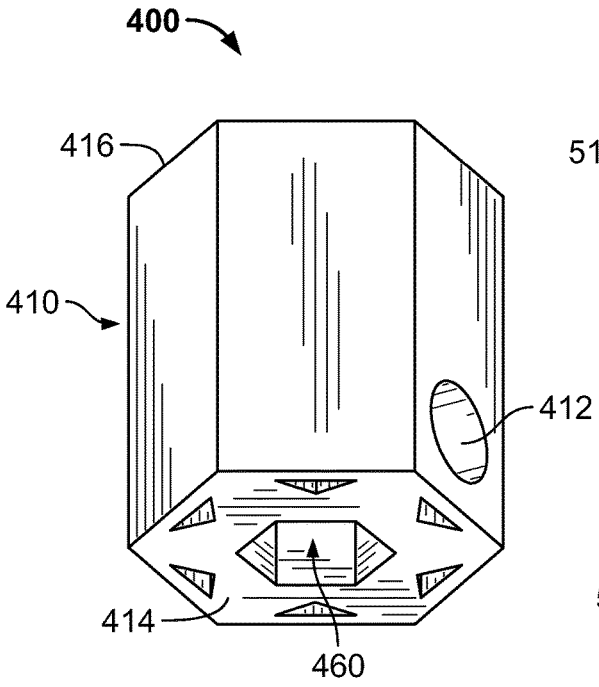
FIG. 10 illustrates a perspective view of a body member that may comprise an end member.

FIG. 10 illustrates a perspective view of a body member 400 in accordance with various described aspects. In at least one embodiment, the body member 400 may comprise an end member or cap of a bit assembly as described herein. The body member 400 may be similar to and/or comprise similar components as other body members (e.g., body members 100, 200, etc.). For instance, body member 400 may comprise a polygonal (e.g., hexagonal) main body 410. In another aspect, body member 400 may include a magnet (e.g., similar to magnet 130) and/or various other components not shown for sake of brevity. Like body members described herein, the main body 410 of a body member 400 may comprise various shapes. For instance, main body 410 may comprise shapes such as polygonal prisms, a cylinder, a cone (or portion thereof), irregular shapes, or the like.

In an aspect, the body member 400 may differ from other body members (e.g., body member 200) in that a distal side 416 may comprise a flat surface or a surface that does not comprise a bit. For example, the body member 400 may not have a bit portion (e.g., bit 140, 240, 340, etc.). In another aspect, one or more sides of body member 400 may comprise one or more apertures on its surface. As depicted, body member 400 may include an aperture 412. The aperture 412 may be utilized to connect body member 400 to another body member. Body member 400 may include proximal side 414, which may include an opening to a chamber 460. In an aspect, the chamber 460 may receive a bit of another body member. In one embodiment, a removable bit of a body member (e.g., body member 200) may be dissembled from its main body and connected to a body member 400 by, for example, inserting the bit into an aperture 460 of the body member 400. Thus body member 400 may be changed into another body member with a bit disposed thereon.

As an example, a user may wish to cover or cap an exposed bit of a body member. For instance, a bit may comprise a sharp end, writing utensil, or other bit type that a user may want to cover to protect the user and/or the bit. The user may attach the body member 400 to cap or cover the exposed bit. In another aspect, the body member 400 may be utilized as a magnetic instrument due to the magnet disposed in the main body of the body member 400. For example, the body member 400 may be used to put notes on metal surfaces. The body member 400 may also be used to attract small metallic objects, such as clips, to keep them from being lost or make them easy to be found.

Figure 11:
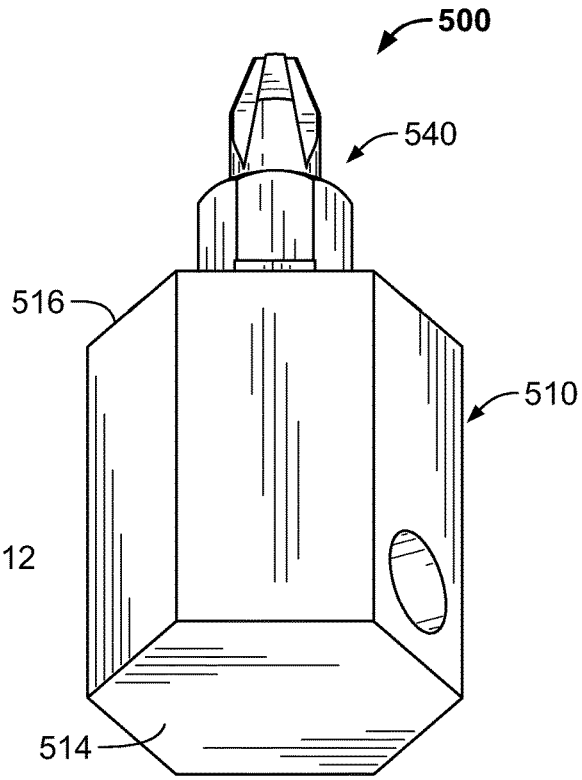
FIG. 11 illustrates a perspective view of a body member that may comprise an end member.

FIG. 11 is a body member 500 in accordance with various disclosed aspects. In at least one embodiment, body member 500 may comprise an end or plug member of a tool assembly. For example, body member 500 may be coupled with another body member to close or cover exposed cavities. In an aspect, the body member 500 may comprise similar aspects or components as embodiments described herein. For instance, body member 500 may comprise a main body 510 that may comprise a polygon prism shape (e.g., hexagonal shape, etc.) or other shapes. The main body 510 may comprise a bit 540 that may protrude from a distal end 516. In another aspect, the main body 510 may comprise a proximal end 514 that may be opposed to the distal end 516. The proximal end 514 may include a generally flat surface. According to an embodiment, the proximal end 514 may comprise a solid surface. In an example, the proximal end 514 may not comprise an aperture. For instance, a user may couple the body member 500 with another body member (e.g., body member 200) via the bit 540 and a chamber of the other body member.

It is noted that distal side 416 of body member 400 and proximal side 514 of body member 500 may comprise other components not shown for readability. For instance, the main body 510 may comprise a chamber that is filled with a material or component, such as a magnet, such that proximal side 514 is generally flat. In another aspect, body member 400 may comprise a filled chamber which may contain various kinds of materials, such as a magnet, such that distal side 416 is generally flat. According to another example, the distal side 416 and/or proximal side 514 may comprise an LED light or other component disposed thereon.

Figure 12:
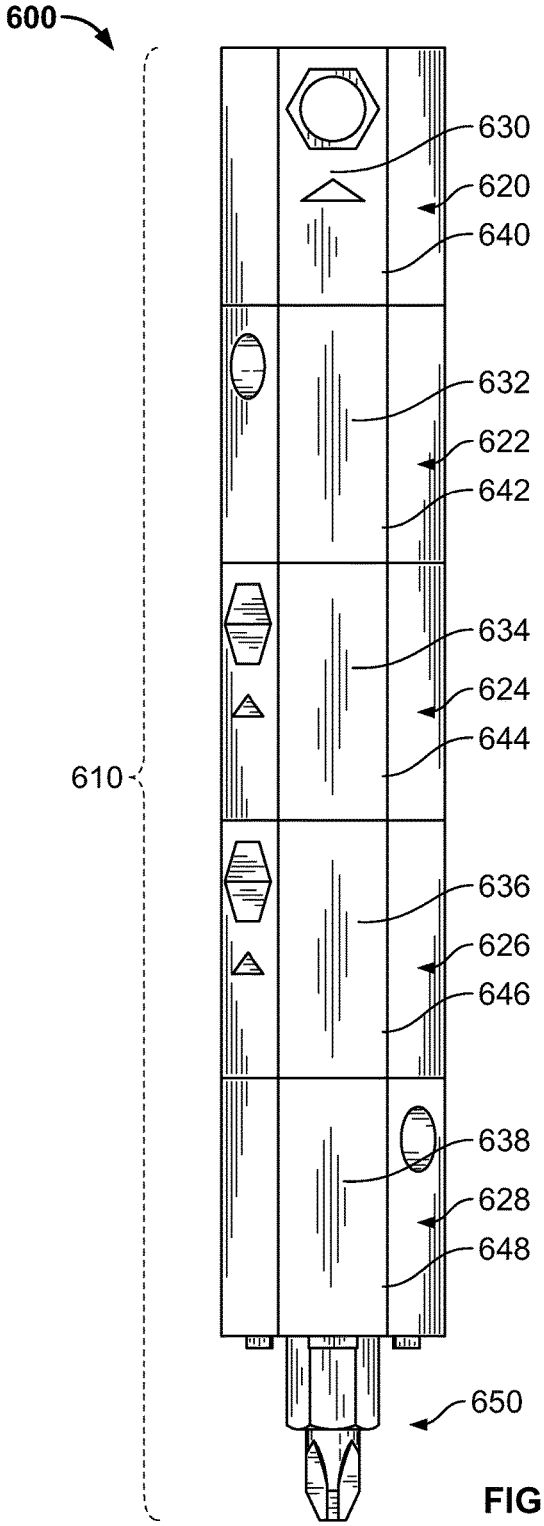
FIG. 12 illustrates a side view of a plurality of body members configured in a straight design with an exposed bit.
Figure 13:
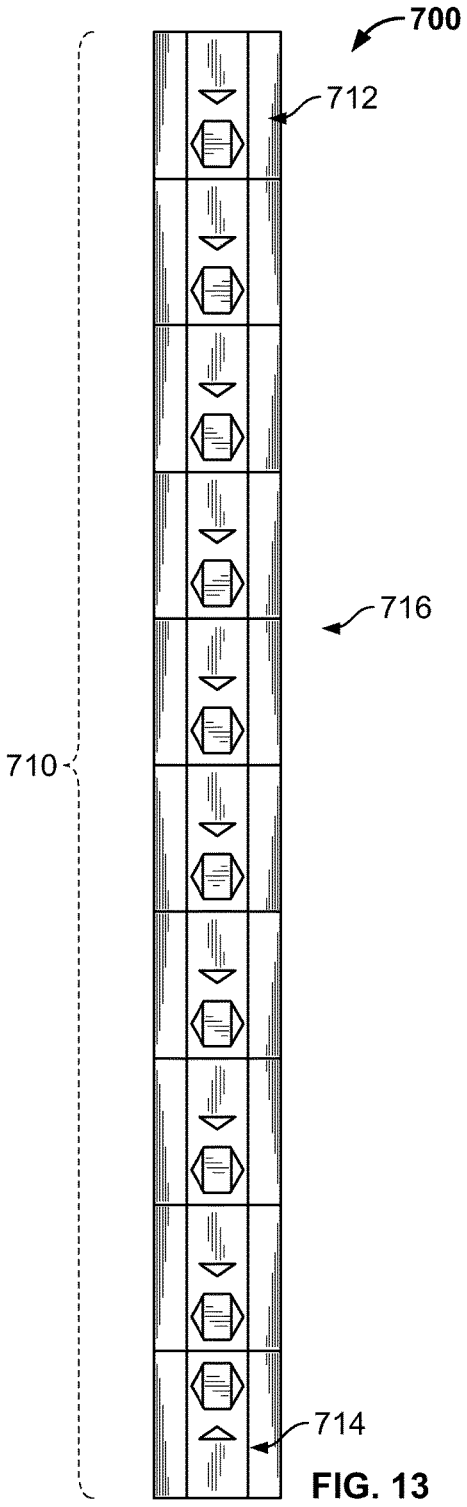
FIG. 13 shows a side view of a plurality of body members and two end members configured in a straight design without exposed bits.
Figure 14:
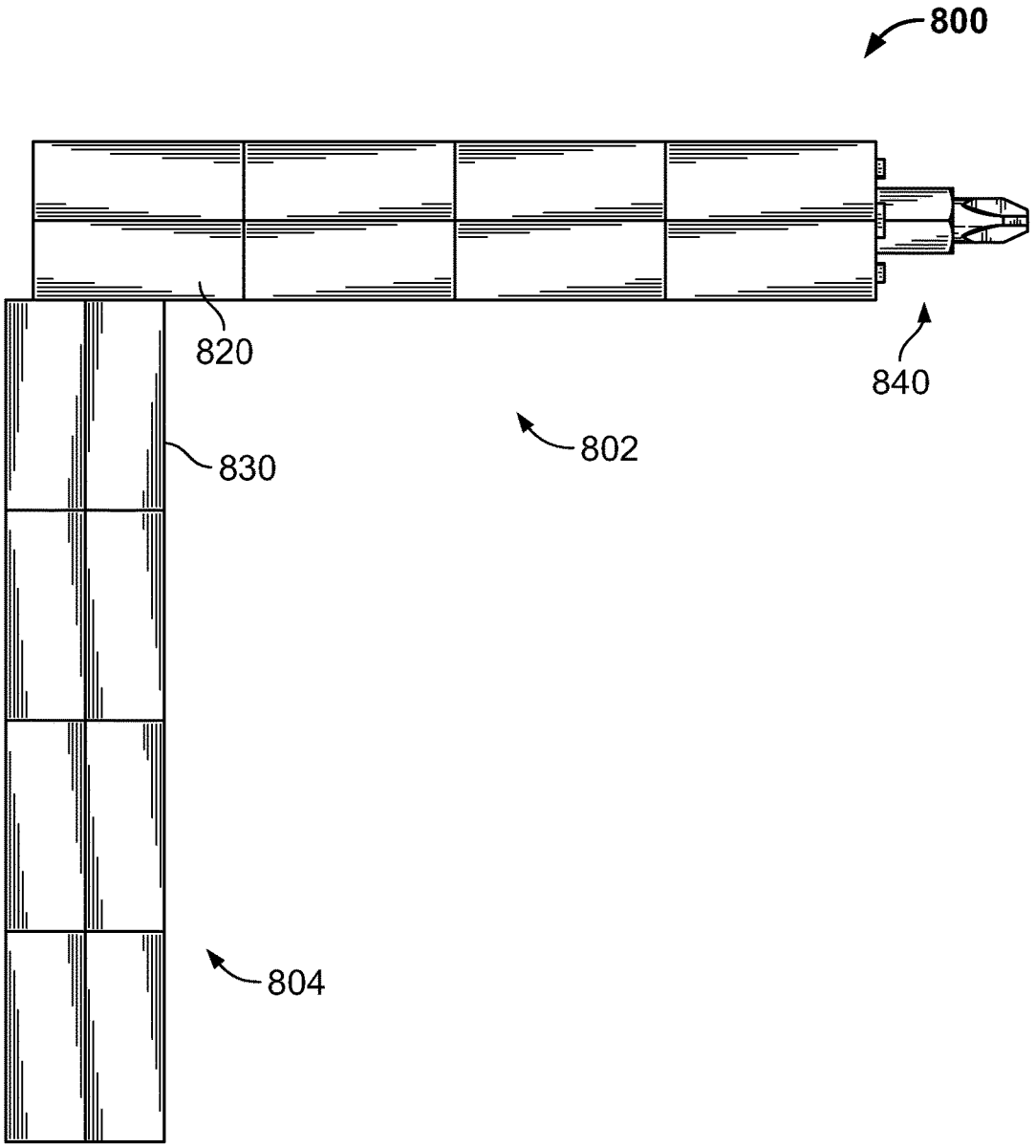
FIG. 14 illustrates a side view of a plurality of body members configured in an L shape.

FIGS. 12-14 depict various bit assemblies that may respectively comprise body members as described with reference to FIGS. 1-11. While FIGS. 12-14 are described as comprising separate bit assemblies, it is noted that the figures may comprise the same bit assembly arranged in different configurations. In another aspect, while the bit assemblies are illustrated as having various body members, the bit assemblies may comprise different numbers of body members. For instance, a bit assembly may comprise j body members, where j is a number. According to embodiments, the body members may be similar to those illustrated in FIGS. 1-11 and/or described here as well as elsewhere in this disclosure. For instance, the bit assemblies may include hexagonal body members, cylindrical body members, ribbed body members, or the like. It is further noted that embodiments of a bit assembly may be assembled into various other configurations (not shown for readability).

Turning to FIG. 12, depicted is a bit assembly 600. The bit assembly 600 may comprise a plurality of body members 610 that may be connected and positioned in a straight design. For instance, the plurality of body members 610 may comprise a first body member 620, a second body member 622, a third body member 624, a fourth body member 626, and a fifth body member 628. Each of the plurality of body members 610 may respectively comprise sides 630, 632, 634, 636, and 638. In another aspect, each of the plurality of body members 610 may respectively comprise edges 640, 642, 644, 646, and 648. It is noted that the edges 640, 642, 644, 646, and 648, and other edges in the bit assembly may comprise sharp or non-beveled edges. In an aspect, one or more of the edges may be chamfered, beveled, or tapered.

The body members 610 may be connected by inserting a bit of a body member into a chamber of another body member. For instance, a bit of first body member 620 may be inserted into an aperture of a second body member 622. A bit of the second body member 622 may be inserted into a chamber of the third body member 624, etc. It is noted that the body members 610 may also be connected by other available means, such as use of an attachment member. In an aspect, a user may change a length of the tool assembly 600 by changing the number of body members 610 being connected. For instance, the user may adjust the number of body members 610 based on a preference or particular application. In an example, the user may select a number of body members 610 such that the user may utilize the bit assembly 600 in hard to reach places.

In another aspect, a user may select a particular body member to dispose at the position of body member 628, such that a desired bit 650 may be exposed. According to an embodiment, respective bits of the body members 610 may be disparate in shape, design, or the like. For example, body member 620 may comprise a flat head screwdriver bit, body member 622 may comprise a writing utensil bit, body member 624 may comprise a hex screwdriver bit, etc. In other examples, at least one body member may comprise other bits, such as a pen/marker, an eyebrow pencil, a lipstick, a pocket knife, and the like. It is noted that the bits may have a common shape or design. For instance, a user may change the size or configuration of the bit assembly 600 based on an application but may desire each bit to be the same.

According to at least one embodiment, the plurality of body members 610 may be configured such that at least two of sides 630, 632, 634, 636, or 638 are coplanar when the body members 610 are assembled. In another aspect, at least two of edges 640, 642, 644, 646, or 648 may be generally aligned. Alignment of the sides and/or edges may facilitate use of the bit assembly 600 as a straight edge (e.g., ruler), level, or the like. Alignment may also allow the bit assembly 600 to be laid flat on a surface.

FIG. 13 illustrates an exemplary embodiment of a bit assembly 700. A tool assembly 700 may comprise a plurality of body members 710 configured in a generally straight line. For instance, bits of body members 710 may be inserted into cavities of other body members. As depicted, the plurality of body members 710 may comprise body members 716 disposed between body member 712 and body member 714. In an aspect, body member 712 may generally comprise an end or cap member (e.g., body member 400). In another aspect, body member 714 may comprise an end or cap member (e.g., body member 500). While body members 712 and 714 may be referred to as end members, it is noted that the body members 712 and 714 may be further attached to other components or body members. However, at least for readability, the body members 712 and 714 may be referred to as end members.

The end members 712 and 714 may be attached to the ends of the bit assembly 700. By having the end members 712 and 714 attached to the ends, the bits of the body members 710 may be enclosed or prevented from exposure. In some embodiments, one or more body members of the tool assembly 700 may contain sharp metal bits, such as drill bits, needles, knife, etc. Attaching end members 712 and 714 to the tool assembly 700 with those bits may provide additional protection to the use of the tool assembly 700. Further in some embodiments, the bits of one or more body members 710 in the tool assembly 700 may comprise certain materials that may wear out or suffer quality reduction much more quickly if lacking necessary protection. For example, writing utensils and cosmetic tools, such as a pen, a marker, a lipstick, etc., may dry out if left exposed. They may also stain the surface to which they contact and cause cleaning problems. In such instances, end members may give additional protection to the tool and extend its working life.

It is noted that the straight configuration of the bit assembly 700 may be configured to facilitate use of the bit assembly 700 as a straight edge, lever, ruler, or the like. It is further noted that at least one of the body members 710 may comprise a leveling mechanism, such as a bubble level disposed therein or thereon. In an example, a user may position a body member 710 comprising the bubble level in generally the center of the bit assembly 700 for taking of measurements.

FIG. 14 depicts an exemplary embodiment of a bit assembly 800 in accordance with various described aspects. The tool assembly 800 may comprise a plurality of body members, such as a first set of body members 802 and a second set of body members 804. The first and second sets of body members 802 and 804 may be connected and configured into an L-shape. The L-shape tool assembly may be formed through different methods. For example, as illustrated, when connecting body member 830 to body member 820 to form the right-angle joint, the bit of body member 830 may be inserted into a particular aperture on body member 820, as described herein. In an aspect, a user may utilize the L-shape as a square to check or measure angles, align objects, draw right angles, or the like. It is further noted that the apertures in the body members may be configured such that the tool assembly 800 may be configured at angles other than 90 degrees (e.g., 45 degrees, etc.).

In another aspect, when the bit of body member 830 is attached to the body member 820 (e.g., such as via an aperture), a magnetic member within the body member 820 may attract the bit of the body member 830. In an aspect, the magnetic attraction may hold or secure the body member 830 into place. In another aspect, mechanical nesting may contribute to securing the body member 830 with the body member 820, as described herein. Further in an aspect, the triangular (or other appropriate shapes) apertures and pegs on the respective sides of body members 820 and 830 that are attached together may provide additional securing mechanism.

According to embodiments, the L-shape bit assembly 800 may also be assembled using other connecting methods, such as employing an attachment member. The bit assembly 800 may comprise body members that may include different bits on one of its end. As shown in FIG. 14, the bit head of body member 810 may comprise a screwdriver head, thus making the tool assembly an L-key screwdriver. In another example, the bit of body member 810 may comprise a hardware tool, such as a hammer, a drill bit, a needle, or the like. In an L-shape bit assembly 800, whatever type of bit head body member 810 may comprise, one side of the bit assembly 800 may make a handle for a user to conveniently hold the tool assembly 800. In an example, a user may position the bit assembly 800 such that a bit 840 may be utilized. The user may hold the first set of body members 802 in one hand, and may spin or rotate the bit 840 by rotating the second set of body members 804 in a cranking manner. In an aspect, this may allow the bit assembly 800 to be utilized as a hand drill.

Figure 15:
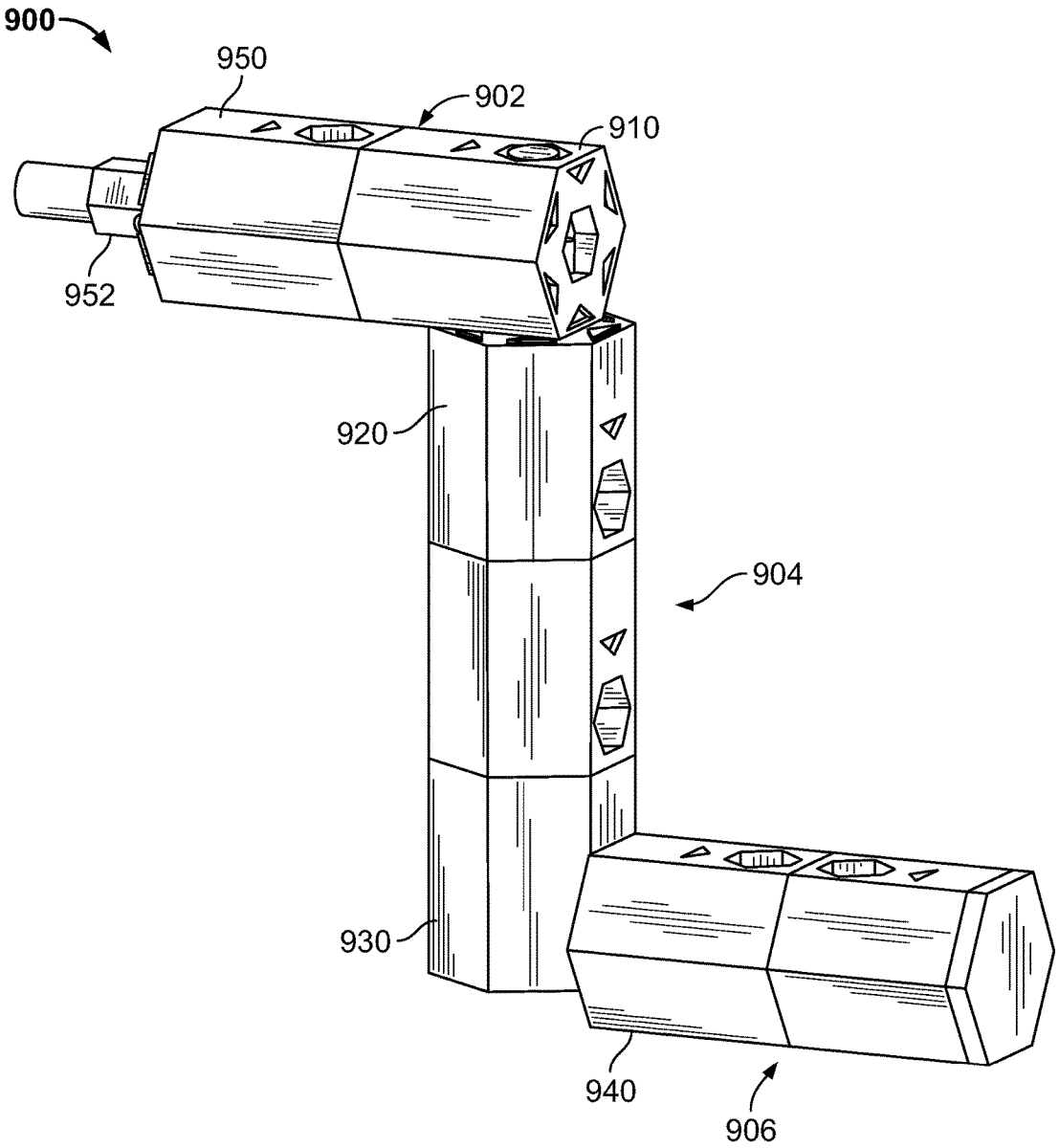
FIG. 15 illustrates a side view of a plurality of body members configured in a Z shape.

FIG. 15 depicts an exemplary embodiment of a bit assembly 900 in accordance with various described aspects. The bit assembly may comprise a variety of body members, such as a first set of body members 902, a second set of body members 904, and a third set of body members 906. Bit assembly 900 may be connected and configured into a Z shape. Like the L-shape bit assembly shown in FIG. 14, the Z-shape bit assembly 900 may be assembled by connecting a body member on one end of a first set of body members 902 to a body member on one end of a second set of body members 904. For example, as illustrated in FIG. 15, body member 910 of the first set of body members 902 may be connected to body member 920 of the second set of body members 904, and body member 930 of the second set 904 may be connected to body member 940 of the third set of body members 906. In embodiments, the Z-shape bit assembly 900 may be assembled via different connecting mechanisms. For example, it may be connected by inserting the bit of one body member in the first set of body members 902 to an aperture of another body member in the second set of body members 904. It is noted that other connecting methods, such as utilizing an attachment member, may also be used.

As described with reference to the bit assemblies shown in other drawings (e.g., FIG. 12, FIG. 14, etc.), the bit assembly 900 may comprise a body member 950 on its end that may have different bits to satisfy different purposes. For example, as shown in FIG. 15, body member 950 may comprise a drill bit as the bit head 952. In an aspect, the bit assembly 900 may be used as a hand drill. For instance, a user can hold the first set of body members 902 in place, and then rotate or spin the bit 950 by rotating second/third sets of body members 904 and/or 906 in a cranking manner. The user may allow the set of body members 902 to rotate by loosely gripping the set of body members 902.

In at least one embodiment, the bit assembly may contain sixteen body members. The sixteen body members may be divided into two groups, each group of which may contain eight body members. In an aspect, each group may include two body members that may comprise end members. Further in an aspect, in one group, each body member may contain a magnet that has the same north and south polarity. For example, every body member in one group may contain a magnet that has a top-facing north pole and a bottom-facing south pole. The body members in the other group may have an opposite north and south polarity. For instance, every body member in the other group may contain a magnet that has a top-facing south pole and a bottom-facing north pole.

What has been described above includes examples of the present specification. It is, of course, not possible to describe every conceivable combination of components or methodologies for purposes of describing the present specification, but one of ordinary skill in the art may recognize that many further combinations and permutations of the present specification are possible. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A body component of a bit assembly, the body component comprising a main body comprising a first aperture disposed on a first lateral side of the main body and a second aperture disposed on a second lateral side of the main body, wherein the first aperture comprises a shape that is different from a shape of the second aperture;

a bit extending from a distal end of the main body; and a chamber formed through at least a portion of the main body, the chamber comprising an opening in a proximal end of the main body;

a magnet disposed within the main body proximal to the bit such that the magnet operatively magnetizes the bit, and wherein the chamber is configured to receive a bit of another body component.

2. The body component of claim 1, wherein the bit comprises a bit head and a bit body.

3. The body component of claim 2, wherein the bit head comprises at least one of a screwdriver head, a drill bit, a writing utensil bit, a lighting bit, a toy bit, or a cosmetic bit.

4. The body component of claim 2, wherein the bit body comprises a generally hexagonal prism shape.

5. The body component of claim 1, wherein the main body comprises at least one of a generally polygonal prism shape or a generally cylindrical shape.

6. The body component of claim 1, wherein the first aperture comprising a shape configured to receive at least a portion of the bit.

7. The body component of claim 6, wherein the bit comprises a bit head and a bit body and wherein, the second aperture is sized and shaped to generally prevent reception of the bit body.

8. The body component of claim 7, wherein the first aperture and the second aperture are generally coaxial.

9. The body component of claim 1, wherein the main body component comprises an identifier that indicates a property of the bit, the identifier comprising at least one of a color, a shape, or indicia.

10. A multi-purpose bit assembly comprising:

a plurality of body members, the plurality of body members comprising a first body member and a second body member, wherein the first body member comprises:

a main body that comprises at least one chamber, the at least one chamber comprising an opening at generally a center of a proximal side of the main body; and a first aperture at generally off-center of the proximal side of the main body;

a second aperture disposed on a lateral side of the main body the second body member comprises:

at least one bit protruding from a distal side of the second body; and at least one peg protruding from the distal side of the second body, wherein the chamber of the first body member operatively receives the bit of the second body member and the first aperture operatively receives the at least one peg to attachably couple the first body member to the second body member, and wherein the second aperture is sized and shaped to operatively receive the at least one peg.

11. The bit assembly of claim 10, wherein the first body further comprises a bit that is a different shape than a shape of the bit of the second body.

12. The bit assembly of claim 10, wherein the first body member further comprises a magnet configured to attract the bit of the second body within the chamber.

13. The bit assembly of claim 10, wherein the first body member further comprises a bit protruding therefrom, and wherein the second body member further comprises a chamber.

14. The bit assembly of claim 10, further comprising at least one attachment member coupled to at least one of the plurality of body members.

15. The bit assembly of claim 10, wherein the first body member further comprises:

a first aperture on first lateral side of the first body, wherein, the first aperture is operatively shaped to receive the bit of the second body.

16. The bit assembly of claim 10, wherein the first body member and the second body member are further configured to be attachably coupled via at least one of a magnet, a threaded member, a pin, or mechanical nesting of the bit of the second body member within the chamber of the first body.

17. A multi-purpose bit assembly comprising:

a plurality of body members, each of the plurality of body members comprising:

a main body comprising a magnet, a first aperture disposed on a first lateral side of the main body and a second aperture disposed on a second lateral side of the main body;

a bit disposed on a distal end of the main body;

a chamber formed through a portion of the main body, the chamber comprising an opening on a proximal end of the main body;

an upper chamber formed between the chamber and the distal end;

a spacer positioned between the upper chamber and the chamber; and a magnet disposed within the main body and comprising a first side having a first charge and a second side having a second charge, wherein the first side is disposed proximal the at least one bit and the second side is disposed proximal the chamber, and wherein the plurality of body members are configured to be coupled together by inserting a bit of a body member into a chamber of another body member, and wherein the first aperture comprises a shape that operatively receives a bit of an other body member of the plurality of body members while the second aperture comprises a different shape that does not receive the bit of the other body member.

18. The bit assembly of claim 17, wherein the plurality of body members are further configured to be coupled into at least one of a straight design, an L shape, an S shape, a Z shape, or a T shape.

19. The bit assembly of claim 17, wherein at least one of the main bodies comprises a hexagonal shape, at least one a portion of the bit comprises a hexagonal shape, and at least a portion of the chamber comprises a hexagonal shape.

* * * * *